United States Patent [19]

Cornett et al.

[11] Patent Number: 4,724,432

[45] Date of Patent: Feb. 9, 1988

[54] GENERATION OF GRAPHIC SYMBOLS FOR CATHODE RAY TUBE DISPLAYS

[75] Inventors: Johnny A. Cornett, Crozet; Thomas Beazell, Charlottesville, both of Va.

[73] Assignee: Sperry Marine Inc., Charlottesville, Va.

[21] Appl. No.: 765,754

[22] Filed: Aug. 15, 1985

[51] Int. Cl.[4] ..... G09G 1/10

[52] U.S. Cl. ..... 340/739; 340/741; 340/736

[58] Field of Search ..... 340/739, 740, 741, 742, 340/736

[56] References Cited

U.S. PATENT DOCUMENTS

| | | | |
|---|---|---|---|
| 3,482,086 | 12/1969 | Caswell | 340/741 |
| 4,001,806 | 1/1977 | Sweeting | 340/739 |
| 4,237,458 | 12/1980 | Lantz et al. | 340/739 |
| 4,369,441 | 1/1983 | Wohlmuth | 340/739 |
| 4,535,328 | 8/1985 | Morly | 340/739 |
| 4,595,918 | 6/1986 | Dettmer | 340/739 |

*Primary Examiner*—Gerald L. Brigance

*Attorney, Agent, or Firm*—Seymour Levine

[57] ABSTRACT

The present invention is an apparatus for reducing distortion at the beginning of a line drawn on the face of a CRT. The line is started while the CRT intensity remains blanked. As the line reaches the position on the CRT where it is to be visible, the CRT intensity is enabled.

5 Claims, 2 Drawing Figures

GENERATION OF GRAPHIC SYMBOLS FOR CATHODE RAY TUBE DISPLAYS

BACKGROUND OF THE INVENTION

1. Field of the Invention

The present invention relates to the generation of graphic symbols and characters for presentation on a Cathode Ray Tube (CRT).

2. Description of the Prior Art

In many Cathode Ray Tube applications, the presentation of graphic symbols and characters with low distortion particularly at the beginning of a line is of prime importance. Radar systems and radar collision avoidance systems are examples of applications where high quality graphic symbols and characters are needed.

Most CRT systems use magnetic deflection of the electron beam to draw graphic symbols. When deflection voltage is applied to the deflection coils of the magnetic deflection system, the beginning of the graphic symbol being drawn on the face of the CRT is distorted due to the inherent inductive lag of the deflection coils while the deflection circuit is charging.

Previous solutions have employed an impulse or step voltage across the deflection coils slightly before the start of a graphic symbol in an effort to reduce distortion. Other schemes have included adding a fixed bias across the deflection coils. With a fixed bias arrangement, the distorted beginning portion of a graphics symbol begins before the desired x—y start point and the electron beam is kept blanked for a predetermined period of time until the desired x—y start point is reached. The disadvantage of a fixed bias arrangement is that additional circuitry is required to detect when the desired x—y start point has been reached or the fixed bias must change as a function of the CRT range scale of the drawing rate of the graphics symbol.

SUMMARY OF THE INVENTION

The apparatus of the present invention provides an apparatus for graphics generation. Each line of graphics symbol or character is defined by the following five parameters:

XPOS—X POSITION START
YPOS—Y POSITION START
SIN$\theta$—SINE OF ANGLE OF LINE WITH VERTICAL
COS$\theta$—COSINE OF ANGLE OF LINE WITH VERTICAL
LENGTH—LENGTH OF LINE The values for the above parameters are stored in the memory of an associated digital computer. When it is desired to draw a line, these values are converted to analog form in a digital-to-analog (D/A) converter and loaded into the sample and hold circuits. Line length values are entered into the length counter/latch in digital form. The line to be drawn is started while the electron beam is still blanked so that the distortion associated with the start of a line is not visible.

The x—y start position is "backed-up" from the desired x—y start position along the axis of the line to be drawn a predetermined distance by summing a portion of the sin$\theta$ and cos$\theta$ values with the desired x-start position and y-start position in the x-sweep and the y-sweep summer/buffers, respectively.

Sin$\theta$ and cos$\theta$ values are integrated and supplied to the x-sweep and y-sweep summer/buffers which begin to move the x—y position along the axis of the line to be drawn. When the desired x—y start point is reached, the start delay enables the intensity and the line is visible on the face of the CRT. When the counter/latch has been decremented to zero, the stop delay, which provides the same delay as the start delay, begins timing. At the end of the stop delay period, the intensity is blanked and integration is stopped.

DESCRIPTION OF THE PREFERRED EMBODIMENT

Figure 1:
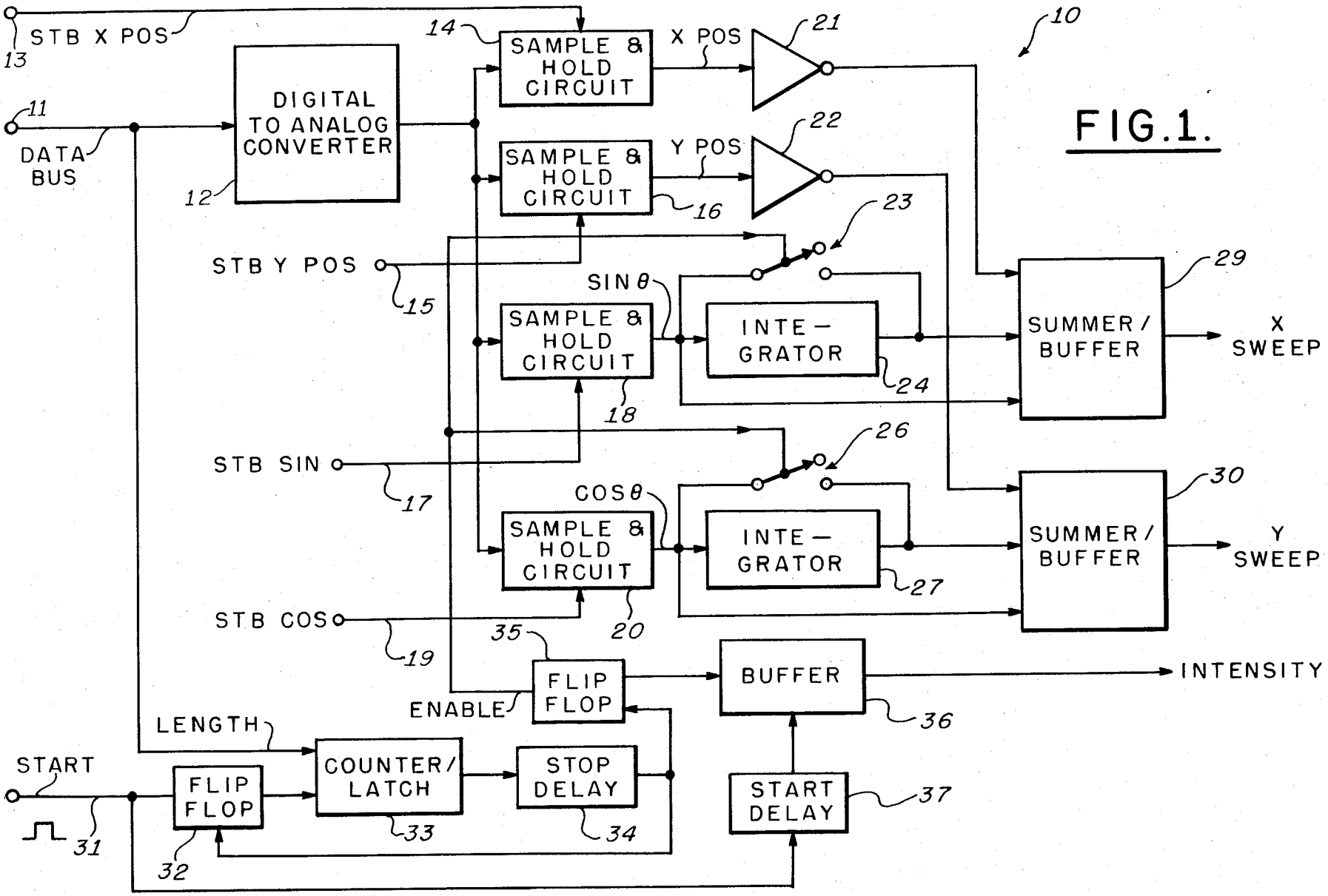
FIG. 1 is a block diagram of the invention.
Figure 2:
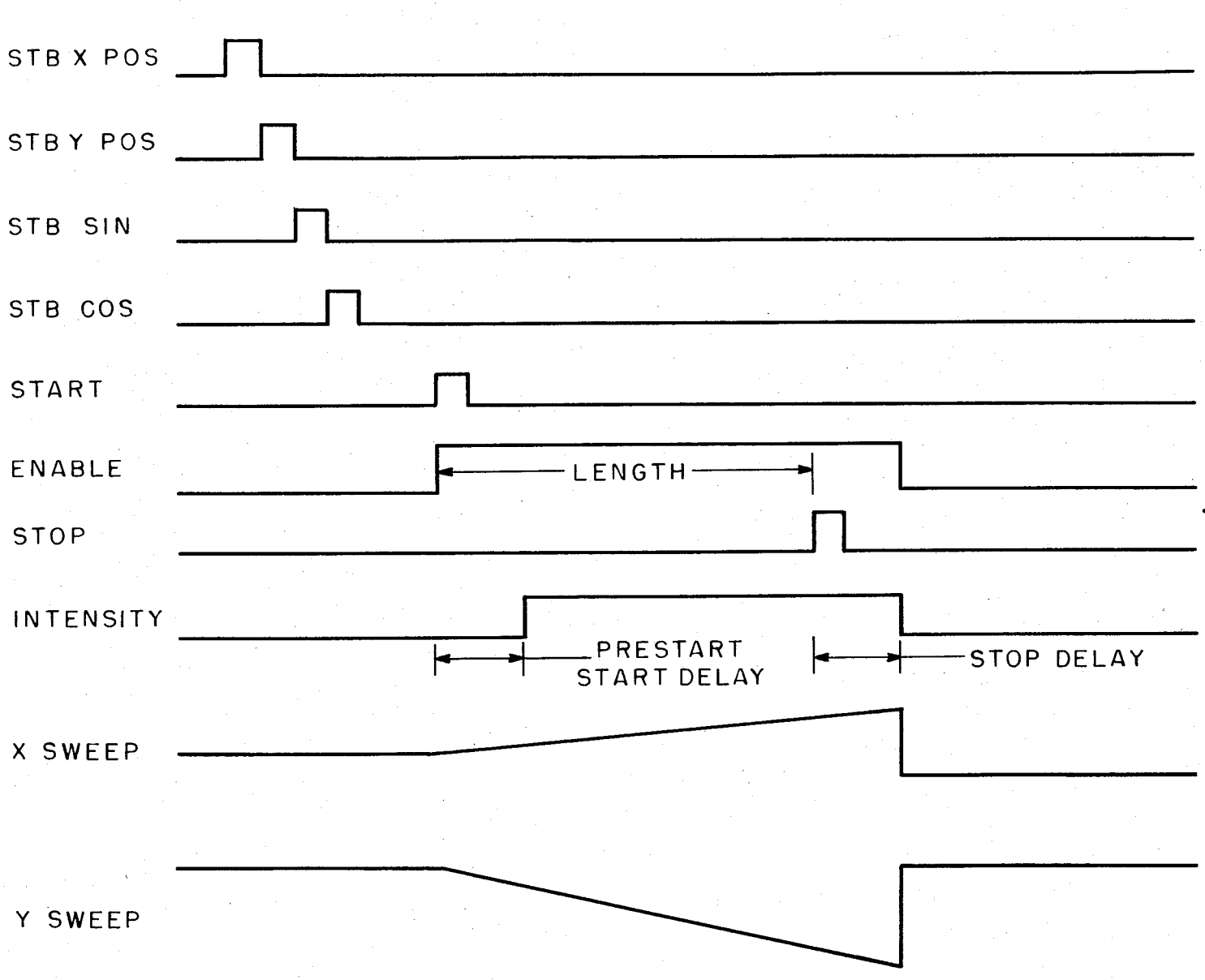
FIG. 2 is a diagram of the waveform associated with the invention.

FIG. 1 illustrates graphics symbol generator 10. Digital data representing the parameters x-start position, y-start position, sin$\theta$, cos$\theta$ and length of a line to be drawn on the fact of a CRT is provided from an external microprocessor (not shown) on data bus 11. As each of the above mentioned parameters are placed on the data bus 11 by the external microprocessor, the parameter is converted to analog form by digital-to-analog (D/A) converter 12 and simultaneously the corresponding strobe-pulse (STB) enables the sample and hold circuit for that parameter. Specifically, the strobe-pulse appearing on lead 13 enables sample and hold circuit 14, which samples and holds the converted analog signal of the x-start position appearing at the output of D/A converter 12. In a similar manner, the strobe-pulse appearing on the lead 15 enables sample and hold circuit 16 to retain the analog representation of the y-start position and strobe-pulses appearing on leads 17 and 19 enable sample and hold circuits 18 and 20 to hold analog representations sin$\theta$ and cos$\theta$ information respectively. The timing of the four strobe-pulses is depicted in FIG. 2. Length data is provided in digital form from the external microprocessor to counter/latch 33.

When it is desired to draw a line, the external microprocessor places a start-pulse on lead 31. Start-pulse 31 initiates three simultaneous actions; Flip Flop 32 is set thereby causing counter/latch 33 to begin decrementing the length value previously entered from data bus 11; start delay 37 begins timing thereby keeping the intensity blanked a predetermined length of time as illustrated in FIG. 2, and starts to count down the predetermined delay; Flip Flop 35 is set thereby opening switches 23 and 26 which enable the sweep signals.

A portion of the sin$\theta$ value from sample and hold 18 is fed around integrator 24 to summer/buffer 29 which effectively causes the x-start postion, provided to summer/buffer 29 from sample and hold 14 through inverter 21, to back-up along the axis of line to be drawn. As switch 23 is opened, the integrated value of sin$\theta$ at the output of integrator 24 is supplied to summer/buffer 29, thereby moving the x-start position along the axis of the line to be drawn toward the original x-start position. The output of summer/buffer 29 is the x-sweep signal as illustrated in FIG. 2. Similarly, a portion of the cos$\theta$ value from sample and hold 20 is fed around integrator 27 to summer/buffer 30 to back-up the y-start position along the axis of the line to be drawn. The y-start position value is provided to summer/buffer 30 from the output of sample and hold 16 through inverter 22. When switch 26 is opened, the integrated value of cos$\theta$ appearing at the output of integrator 27 is provided to summer/buffer 30 where it is summed with the portion of cos$\theta$ provided directly to summer/buffer 30 and the y-start position value. The output of summer/buffer 30 is the y-sweep signal.

When the x-sweep and y-sweep output of summer/-buffer 29 and 30 reaches the original x-start position and y-start position, start delay 37 times out and enables the intensity. The desired start of the line to be drawn becomes visible on the face of the CRT. The desired line is then drawn by the x-sweep and y-sweep signals applied to the deflection coils of the CRT in accordance with the x-start position, y-start position, cos$\theta$, sin$\theta$ and length parameters supplied by the associated microprocessor. When the counter/latch 33 has decremented the desired line length to zero, it outputs a pulse to stop delay 34. Stop delay 34 has the same amount of delay as start delay 37. When the stop delay 34 times out, Flip Flop 35 is reset thereby inhibiting the intensity and causing switches 23 and 26 to close. The output of stop delay 34 also resets Flip Flop 32.

The present invention achieves a reduction in distortion of graphic symbols by starting the x-sweep and y-sweep a predetermined time before the intensity is enabled. Thus, the distortion present at the beginning of a line is not seen on the CRT. A counter/latch, after decrementing the desired length, initiates a stop delay which disables the intensity after a predetermined time. Start and stop delays having the same delay time result in the desired line length being visible on the CRT.

While the invention has been described in its preferred embodiments, it is to be understood that the words which have been used are words of description rather than limitation and that changes may be made within the purview of the appended claims without departing from the true scope and spirit of the invention in its broader aspects.

We claim:

1. An apparatus for generating sweep and intensity signals, of the type including means for magnetically deflecting an electron beam across a display face of a Cathode Ray Tube and for blanking said intensity signals, comprising:

means for providing signals corresponding to a desired positional displacement of said beam on said face of said cathode ray tube, means responsive to said positional signals for deflecting said beam a predetermined distance in a first direction along an axis from a first position means for generating a timing signal to provide a predetermined delay for blanking said beam, means responsive to said timing signal and said positional control signals for deflecting said beam in a direction opposing said first direction along said axis, means responsive to said timing signal for enabling the intensity of said beam after said predetermined delay when said beam has reached a position coincident with said first position, means synchronized to said first timing signal for generating a further timing signal to generate a further predetermined delay equal to said predetermined delay, the displacement of said first and second timing signals defining a period corresponding to a desired display of said electron beam, and means for blanking the intensity of said beam after said further delay.

2. An apparatus as set forth in claim 1 for generating sweep and intensity signals for a Cathode Ray Tube further comprising:

first summer means coupled to receive a first signal representative of an x-start position of a sweep signal along a first coordinate axis, a second signal representative of an x-start position angle with respect to a reference and a third signal representative of an integration of said x-start position angle;

second summer means coupled to receive a fourth signal representative of a y-start position of a sweep signal along a second coordinate orthogonal to said first coordinate, a fifth signal representative of a y-start position angle with respect to a further reference and a sixth signal representative of an integration of said y-start position angle, first integration means coupled to receive said signal representative of said x-start position angle for providing said third signal to said first summer means, means coupled to receive data signals from an external microprocessor, for providing said first and fourth signals to said first and second summer means, respectively, and for providing said second and fifth signals to said first and second integration means, respectively, and means for enabling said first and second integration means coincident with a start of said first timing signal and for inhibiting said first and second integration means at an end of said further timing signal.

3. Apparatus according to claim 2 wherein said means for providing said first and fourth signals and said second and sixth signals comprises:

a digital-to-analog converter, a plurality of sample and hold circuits, said digital-to-analog converter being coupled to receive digital signals from said external microprocessor for providing analog signals to said sample and hold circuits, said sample and hold circuits each being adapted to receive a strobe pulse for sequentially enabling each of said sample and hold circuits to sample and hold output of said digital-to-analog converter.

4. Apparatus according to claim 2 wherein said means for enabling and inhibiting said first and second integration means and for enabling and blanking said CRT intensity comprises:

a counter latch adapted to receive line length data from said external micropressor, means for enabling said counter latch to decrement said line length upon receipt of a start pulse, start delay means for blanking said CRT intensity a predetermined period of time corresponding to said predetermined delay after receipt of said start pulse, stop delay means coupled to receive output from said counter latch and delay said output a time interval equal to said start delay time interval, means coupled to receive output of said stop delay for inhibiting said first and second integration means and said CRT intensity.

5. Apparatus according to claim 4 wherein said means for enabling said counter latch and said means coupled to receive output of said stop delay each comprises a flip-flop circuit.

* * * * *